US006145524A

United States Patent [19]

Li et al.

[11] Patent Number: 6,145,524

[45] Date of Patent: Nov. 14, 2000

[54] STAIR CLIMBING WALKER

[76] Inventors: Tianfu Li, 27165 Colleen Ct., Dearborn Hts., Mich. 48127; David Keith Blair, 621 Kingsborg Ave., Dearborn, Mich. 48128

[21] Appl. No.: 09/074,761

[22] Filed: May 8, 1998

[51] Int. Cl.[7] ..... A61H 3/00

[52] U.S. Cl. ..... 135/67; 135/69; 135/75; 297/6

[58] Field of Search ..... 135/65–67, 69, 135/75, 72, 70; 297/5–6; 280/87.021, 87.041; 482/66–69

[56] References Cited

U.S. PATENT DOCUMENTS

| | | | |
|---|---|---|---|
| 1,394,224 | 10/1921 | Scott | 135/67 X |
| 2,474,722 | 6/1949 | Blume | 135/69 |
| 3,354,893 | 11/1967 | Schmerl | 297/6 X |
| 3,387,617 | 6/1968 | Reiber | 135/67 |
| 3,455,313 | 7/1969 | King | 135/67 |
| 3,688,789 | 9/1972 | Bunch | 135/67 |
| 5,349,977 | 9/1994 | Wood | 135/67 |
| 5,649,558 | 7/1997 | Richard | 135/67 |
| 5,787,913 | 8/1998 | Li | 135/67 |

*Primary Examiner*—Carl D. Freidman
*Assistant Examiner*—Winnie Yip
*Attorney, Agent, or Firm*—Tianfu Li; David K Blair

[57] ABSTRACT

A walker for assistant people ambulating, particularly on stairs climbing, is a free standing frame comprising a pair of reverse U-shaped frame members that are interconnected by braces at its sides and front, having the walker open on its rear side to allow access by the user. The horizontal parts of the U-shaped members provide handles for gripping the walker. A pair of adjustable front legs are telescopically inserted in the frame and are held in fixed position relative to the frame by a spring lorded pin mounted on the frame passes through the hole on the frame and the front leg. In one embodiment, hand actuated controls mounted on the handles allow the user to pull the pin out of the holes whereby the front legs extend by falling under the force of gravity to the desired length where the pin re-locking the front legs. Alternatively, the front leg are shortened by unlocking the front legs, pressing the front legs against a fixed surface until the legs are at the desired length where the pins are re-locked. In another embodiment, a reversible electro-Magnet force driving the bolts in and out the holes to locking or unlocking the front legs.

17 Claims, 3 Drawing Sheets

STAIR CLIMBING WALKER

BACKGROUND OF THE INVENTION

1. Field of the Invention

This invention relates to a walker for using by people needing ambulatory assistance. More particularly, this invention relates to an improved walker having a pair legs that may adjusted in length relative to its rear legs to adapt the walker for safe use on stairs.

2. Description of the Prior Art

Walker has been used to assistant physically impaired people. The most used walkers consist of a lightweight, three-sided frame that is self-standing on four legs, which often telescope to adjust the walker's height to conform to the physical characteristics of the user. While such standard walkers provide a stable support when used on level surfaces, they are highly unstable and unsafe when used on stairs.

Attempts have been made to design a walker that is stable and safe to use on all surfaces. Such prior walkers are:

| U.S. Pat. No. | Inventor |
|---|---|
| 2,708,473 | Gable |
| 3,176,700 | Druy |
| 3,387,617 | Reiber |
| 3,387,618 | Swann |
| 3,421,529 | vestal |
| 3,455,313 | King |
| 3,800,815 | Birk |
| 4,777,973 | Nakajimma |
| 5,263,506 | Narramore |
| 5,649,558 | Reginald |

These prior patents disclose mechanisms for extending or retracting some or all of the legs thereof to adapt the walker for use in ascending or descending stairs. However, all of these walker either too expensive and complicate to manufacture or too difficult and unsafe to use.

SUMMARY OF THE INVENTION

It is an object of this invention to provide an improved walker for assisting physically impaired people in ambulating.

It is another object of this invention to provide an improved walker for assisting physically impaired people in ascending and descending stairs.

It is another object of this invention to provide an improved walker for assisting physically impaired people in resting when using the walker for assisting ambulating.

It is another object of this invention to provide an improved walker having a novel mechanism for automatically and selectively controlling the extension and retraction of a pair of legs thereof without removing his/her hands from the walker's handles.

It is another object of this invention to provide an improved walker having a novel electrical-mechanical leg adjustment control that the user may activate without removing his/her hands from the walker's handles.

It is another object of this invention to provide an improved walker easy to manufacture and inexpensive.

It is another object of this invention to provide an improved walker with light weight, easy and safe to use.

In accordance with a preferred embodiment of the invention, a walker for assistant people ambulating, particularly on stairs climbing, is a free standing frame comprising a pair of reverse U-shaped frame members that are interconnected by braces at its sides and front, having the walker open on its rear side to allow access by the user. A sitting board pivotally mounted on one side brace, the board can holed at vertical position when the user is ambulating and can be put horizontally on two opposite side brace for resting. The horizontal parts of the U-shaped members provide handles for gripping the walker. A pair of adjustable front legs are telescopically inserted in the frame and are held in fixed position relative to the frame by a spring lorded pin mounted on the frame passes through the hole on the frame and the front leg. In one embodiment, hand actuated controls mounted on the handles allow the user to pull the pin out of the holes whereby the front legs extend by falling under the force of gravity to the desired length where the pin re-locking the front legs. Alternatively, the front leg are shortened by unlocking the ,front legs pressing the front legs against a fixed surface until the legs are at the desired length where the pins are re-locked . In another embodiment, a reversible electrical-Magnet force driving the bolts out the holes to unlocking the front legs.

DESCRIPTION OF THE PREFERRED EMBODIMENT

Figure 2:
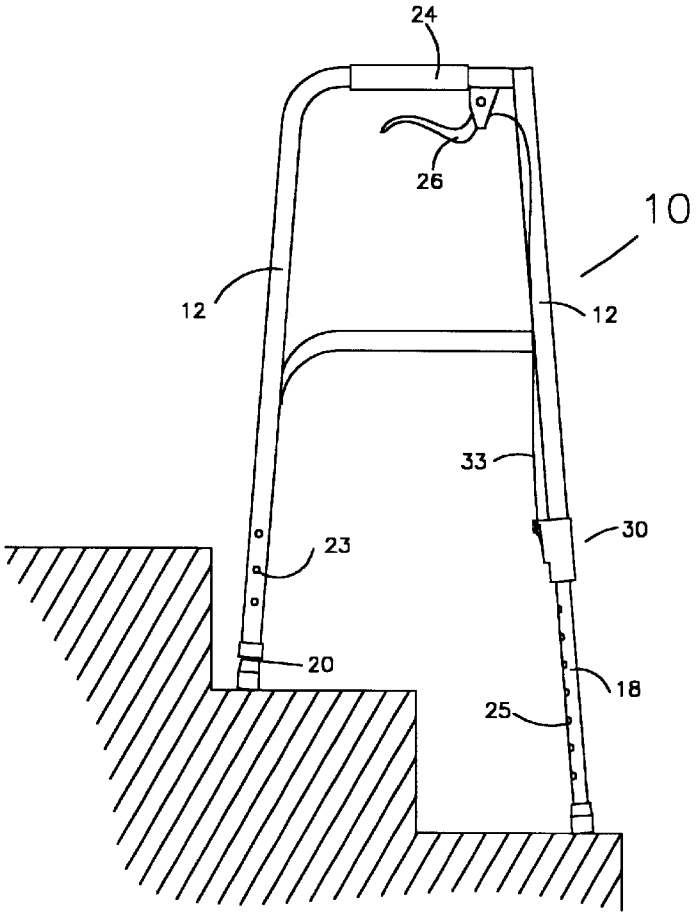
FIG. 2 is side view of a stair climbing walker used to ascend and descend stairs, respectively.

Referring to the drawings, an embodiment of the stair climbing walker having extension/retraction front and rear legs according to the present invention will be described hereunder.

Figure 1:
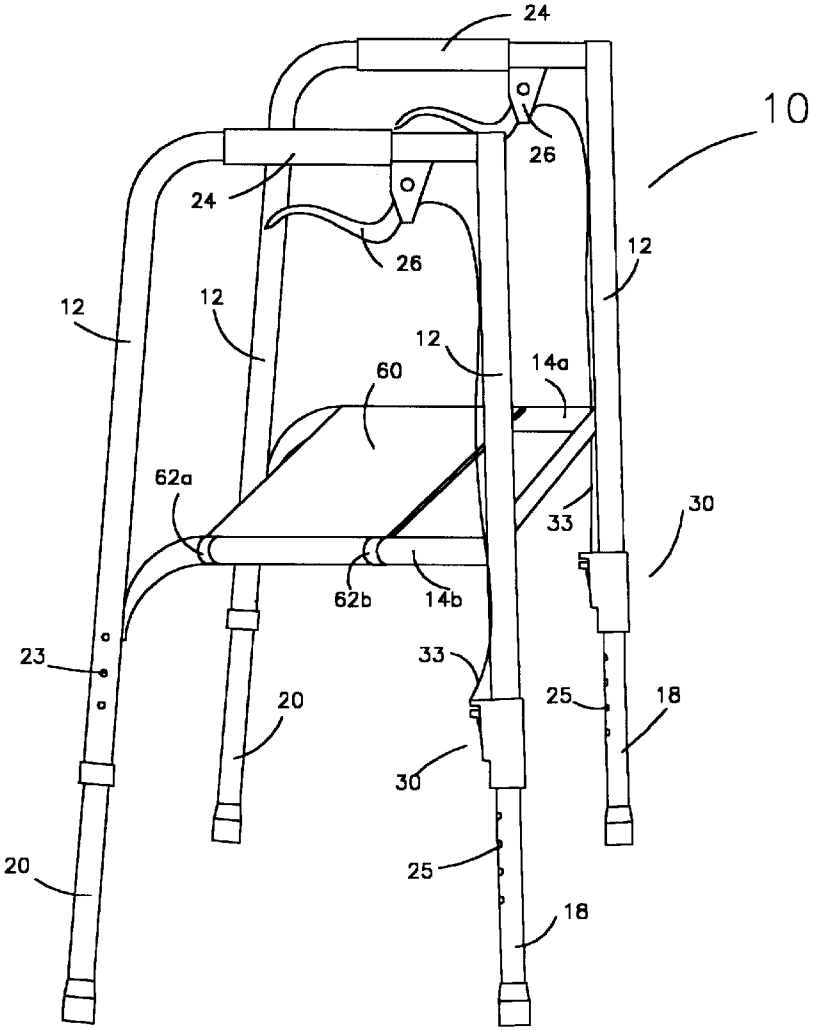
FIG. 1 is a side perspective view of a stair climbing walker according to the present invention.

As shown in FIG. 1, an stair climbing walker designated generally by a reference numeral 10 is constituted by a pair of reverse U-shaped frame pipes 12 and brace 14*a*, 14*b* and, a pair of front legs 18 telescope inserted into the respective front lower ends of the frame pipes 12, a pair of rear legs 20 telescope inserted into the respective rear lower ends of the frame pipes 12, a pair of grips 24 provided on the horizontal part frame pipes 12 respectively, and a pair of bike brake handle 26 mounted on the frame pipes 12 respectively for controlling the extension/ retraction of the front legs 18 through a pair of locking device 30. The locking device 30 mounted on the lower end front frame pipes 12.

FIG. 2 illustrates one of the pair of frame pipes 12. The front leg 18, the rear leg 20, Bike brake handle 26 and locking device 30, the rear frame leg 12 has a plurality of leg extension holes 21 respectively, that cooperate with spring loaded push button 23 to allow the walker to be adjusted to the height of the user as necessary. The front leg 18 has a plurality of leg extension holes 25 respectively, that cooperate with the locking device 30 to allow the walker to be adjusted to the height of the stair. The control handle 26, show here as bike brake grip is mounted on frame 12 adjacent to right handle 24 and functions to release the front leg that controls the extensions and retractions of the front leg 18.

Figure 3:
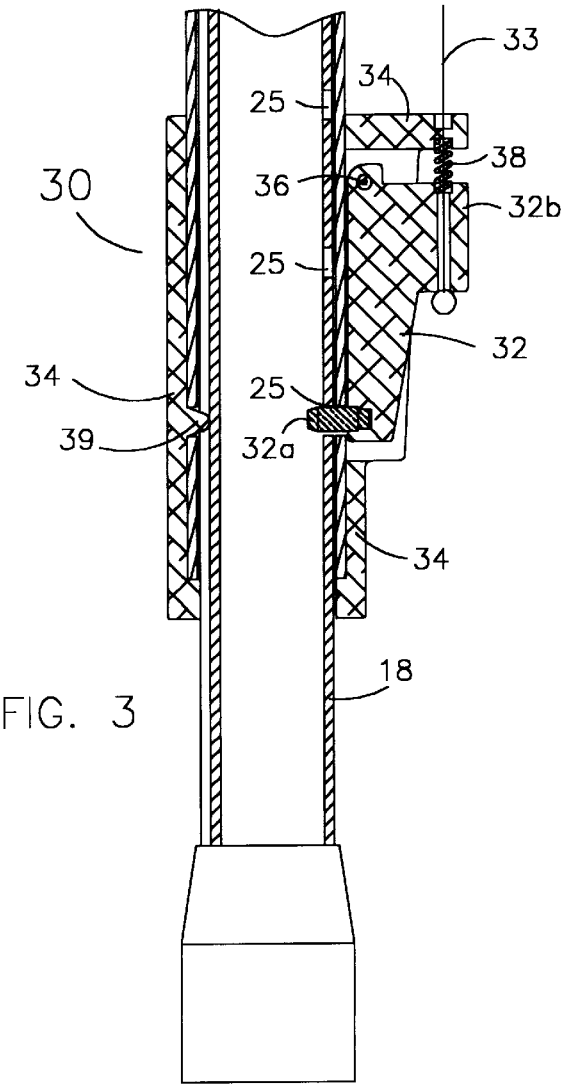
FIG. 3 is a detailed partly cut-away side view of one embodiment of locking device in its locking position, showing the locking mechanisms that control the extensions and retractions of the adjustable front legs.
Figure 4:
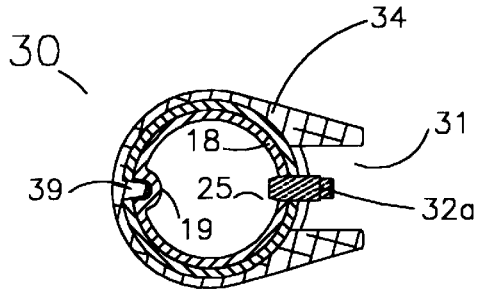
FIG. 4 is a detailed partially cut-away top view of the embodiment of locking device shown in FIG. 3.

FIGS. 3 and 4 illustrates the locking device 30 has housing 34 mounted on the lower end of the front frame legs 12, the housing 34 has a longitudinally window or slot 31 that extends along the posterior or rear-facing side of the front frame leg 12, a longitudinally convex protrusion 39 extends along the anterior side of the frame leg 12 cooperate with the concave slot 19 on the leg 18 to prevent the front legs 18 from rotation. In the window 31 has a "L" shaped pin 32 engaged with the housing 34 through the axis 36 and has head of the pin 32*a* on one end inserts into extension holes 25, a helical spring 38 mounted in-between the other end of the pin 32 and the spring block 37 on the housing 34 to hold the pin in locking position, a bike brake cable 33 has one end mounted to the bike brake grip 26 and its other end pass through the spring 38 mounted to the end of the pin 32*b*, by pulling the cable 33 to overcome the biasing force of the spring 38, the pin 32 will pivot on the axis 36 to unlocking the front leg 18.

Figure 5:
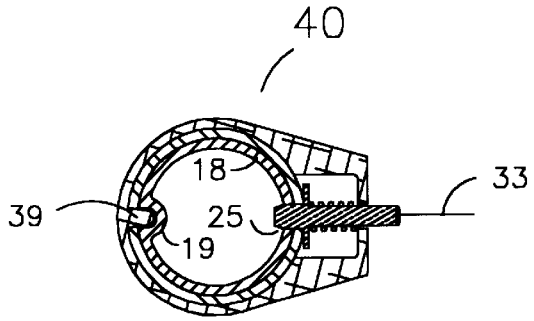
FIG. 5 is a detailed partially cut-away top view of another embodiment of locking device.

Referring FIG. 5, show another embodiment of the locking device 40 has helical spring 44 biased straight ping 42 connect with bike brake cable 33 can performing the same locking mechanism.

Figure 6:
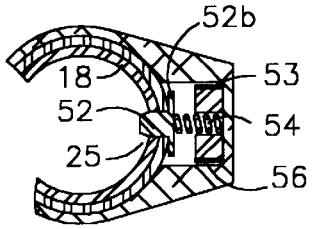
FIG. 6 is a detailed partially cut-away top view of a potion of another embodiment of electronically-magnet locking device.
Figure 7:
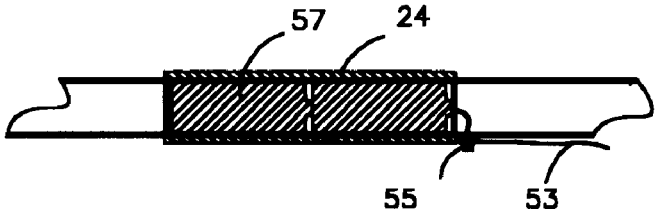
FIG. 7 is cut-away side view of an electrical switch of another embodiment of the hand operated control means.

Referring FIGS. 6 and 7, shows another embodiment of the locking device 50 has helical spring 54 biased straight pin 52 with a iron bass 52*b*, electrical magnet force generated by iron 58 surrounded by primary coil 56, an electronic cable 53 connected the primary coil 56 to the battery located in the handle grip 24, a switch 55 mounted on the frame 12 closed to the handle gripe 24. By control the switch, the electronic magnet force generated by primary coil 56 can overcome the bias force generated by helical spring 54, pull the pin out the hole 25 to along the leg 18 to extension or retraction.

Figure 8:
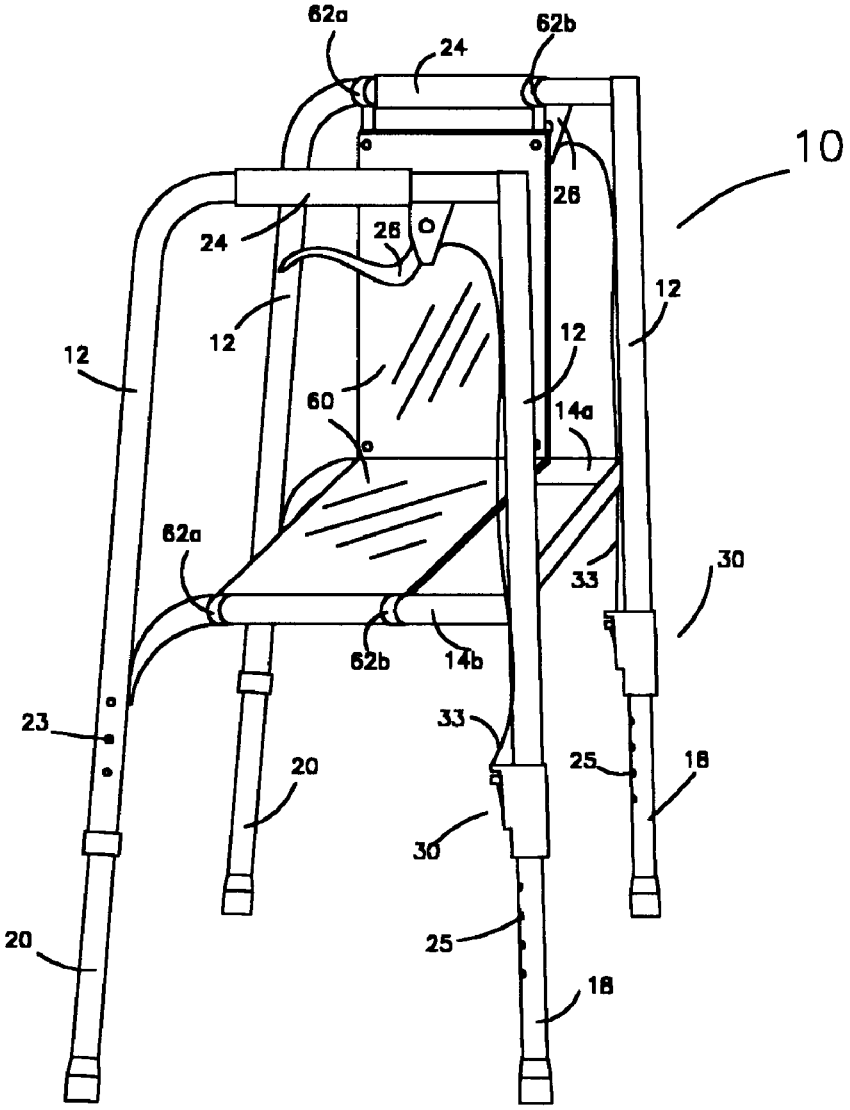
FIG. 8 is a side perspective view of the sitting board in vertical and horizontal position.

Referring FIG. 8, show a sitting board 60 pivotally mounted on the side brace 14*a* has hook 62*a* and 62*b* on one end, The hooks 62*a* and 62*b* hold on the frame 12 to keep the sitting board 60 in vertical position when the user is walking, the hooks hole on the side brace 14*b* to keep the sitting board 60 in horizontal position for user to sit on.

In operation, when the user desires to extend the front legs, the user actuates the control means 26 which will cause the cable 33 to exert an upward force on the end of the pin 32*b* to overcome the biasing action of spring 38 and permit a clockwise rotation the pin 32, thereby causing the head of the pin 32*a* pull out of the hole 25 and permit front leg 18 to extend freely under the force of gravity until it contacts a solid object. When the front adjustable leg 18 is at the desired length, the control handle is released whereby the spring 38 causes the pin 32 to rotate until its head of the pin 32*a* insert into the hole 25. When the user desires to retract the front legs, the user will actuate the handle 26 to pull the head of the pin out of the hole and then apply an upward force on the front legs by, for example, pushing the front legs against the ground or a rigid object until the front legs are at the desired length whereupon the control handle 26 will be released to allow the pin 32 to rotate counterclockwise until it insert into the locking hole 25 and maintain the front leg at the desired length. The user can hang the hooks 62*a* and 62*b* on the frame 12 to keep the sitting board 60 on the vertical position when ambulating, the user also can hang the hooks 62*a* and 62*b* on the side brace 14*b* to keep the sitting board on horizontal position and sit on it.

The present invention has been described in detail with regard to its preferred embodiments in an stair climbing walker having two front leg units that may selectively be extended or retracted to enable the walker to be safely used on stairs. However, as those skilled in the art will readily understand upon a reading of the foregoing specification, modifications and variations may be resorted to without departing from the substance or scope of the invention. Specifically, it is contemplated that the features of the present invention may be equally adaptable for use in walkers having front and rear adjustable legs or rear adjustable legs or side adjustable legs and walkers having foldable frames. Such modifications and variations are within the scope of the present invention.

I claim:

1. An stair climbing walker comprising:

a frame having a pair of reverse U-shaped frame pipes situated parallel to each other, each frame pipe having front and rear lower portions;

cross bar means connected to the respective frame pipes to connect the frame together;

a pair of front legs, each leg telescopically inserted into the front lower portion of one of the frame pipes and having holes mutually spaced along the leg;

first and second locking devices mounted on a first and a second outer ends of the front lower portions of said frame pipes, respectively, each locking device having a pin operatively engaging one of said holes in one of said legs, thereby connecting the leg in a fixed position to the front lower portion of the respective frame pipe, and disengaging said hole to release the leg from the front lower portion of the respective frame pipe; and a hand operated control means positioned on each frame pipe for disengaging each pin from one of said holes and for pushing the pin into engagement with said hole, whereby said legs are adjustable in height individually with respect to the height of the stair.

2. A walker according to claim 1 wherein said pin is pushed into the hole of said front leg by a spring.

3. A walker according to claim 1 wherein said hand operated control means includes a bike brake handle mounted on said frame, and a cable connected to said pin for pulling said pin to unlock the front leg by moving said bike brake handle.

4. A walker according to claim 1 wherein said hand operated control means a electrical switch mounted on said frame has electrical cable connect with a battery, electrical-magnet force generator and switch.

5. A walker according to claim 1 wherein each front leg has a concave slot cooperating with a convex protrusion of the respective locking device to prevent the front leg from rotating.

6. A walker according to claim 1, wherein said frame further includes a brace connected between said front and rear lower portions of said respective frame pipe, and a sitting board pivotally mounted on said brace.

7. The walker according to claim 6 wherein the board can tilt to a vertical position and to a horizontal position.

8. The walker of claim 6 further including a pair of hooks for holding the sitting board in a vertical and horizontal position.

9. The walker of claim 1 further comprising a pair of rear legs, each rear leg being adjustably fixed to the rear lower portion of a frame pipe.

10. An stair climbing walker comprising:

a frame having a pair of mutually parallel reverse U-shaped frame pipes, each frame pipe having front and rear lower portions;

cross bar means connected to the respective frame pipes to connect the frame together;

a pair of front legs, each leg inserted into the front lower portion of one of the frame pipes and having holes mutually spaced along the leg;

a first and second locking devices mounted on a first and a second ends of the front lower portions of said frame pipes, respectively, each locking device having a pin supported to pivot into engagement with one of said hole in one of said legs, thereby connecting the leg in a fixed position relative to the respective frame pipe, and to pivot out of such engagement for releasing said leg from said front lower portion of the frame pipe;

control means positioned on each frame pipe for disengaging each pin from the corresponding hole, and for resiliently urging the pin into engagement with the corresponding hole.

11. The walker of claim 10 further comprising a pair of rear legs, each rear leg being adjustably fixed to the rear lower portion of one of the frame pipes.

12. A walker according to claim 10 wherein said pin is pushed into engagement with the hole of said leg by a spring.

13. A walker according to claim 10 wherein said control means includes a bike brake handle mounted on said frame, and a cable connected to said pin for pulling said pin to unlock the front leg by moving said bike brake handle.

14. A walker according to claim 10 wherein each front leg has a concave slot cooperating with a convex protrusion of the respective locking device to prevent the front leg from rotating.

15. A walker according to claim 10, wherein said frame further includes a brace connected between said from and rear lower portion of said respective frame pipe, and a sitting board pivotally mounted on said brace.

16. The walker according to claim 15 wherein the board can tilt to a vertical position and to a horizontal position.

17. The walker of claim 15 further including a pair of hooks for holding the sitting board in a vertical and horizontal position.

* * * * *